US005957502A

United States Patent [19]

Manico et al.

[11] Patent Number: 5,957,502

[45] **Date of Patent: *Sep. 28, 1999**

[54] DUAL SIDED PHOTOGRAPHIC ALBUM LEAF AND METHOD OF MAKING

[75] Inventors: Joseph Anthony Manico, Rochester; Richard Carroll Reem, Hilton, both of N.Y.

[73] Assignee: Eastman Kodak Company, Rochester, N.Y.

[ * ] Notice: This patent is subject to a terminal disclaimer.

[21] Appl. No.: 09/105,291

[22] Filed: Jun. 26, 1998

Related U.S. Application Data

[63] Continuation of application No. 08/455,770, May 31, 1995, Pat. No. 5,791,692.

[51] Int. Cl.[6] ..... B42D 15/00

[52] U.S. Cl. ..... 283/67; 402/79; 412/1; 412/7

[58] Field of Search ..... 283/67, 117; 402/79; 281/38; 412/1, 33, 7

[56] References Cited

U.S. PATENT DOCUMENTS 2,747,865 5/1956 Marshall, Jr. ..... 412/33
3,797,152 3/1974 Brandt .
5,403,138 4/1995 Otake et al. .
5,791,692 8/1998 Monico et al. ..... 283/67

FOREIGN PATENT DOCUMENTS 1184884 3/1970 United Kingdom .
1506968 4/1978 United Kingdom .

*Primary Examiner*—Willmon Fridie, Jr.
*Attorney, Agent, or Firm*—Frank Pincelli

[57] ABSTRACT

A unitary dual sided album leaf and method of making. The method includes the steps of:

providing a image retaining media having an image forming side and a back side;

printing a plurality of images on the image forming side of the image retaining media, the image retaining media being composed into first and second image retaining sections;

folding the image retaining media along a predetermined line, the first and second image retaining sections being positioned such that when the image retaining media is folded, the back side of the first and second image retaining sections will be substantially co-extensive with each other so as to form the first and second sides of the album leaf.

30 Claims, 5 Drawing Sheets

DUAL SIDED PHOTOGRAPHIC ALBUM LEAF AND METHOD OF MAKING

CROSS REFERENCE TO RELATED APPLICATIONS

This is a Continuation of application Ser. No. 08/455,770, filed May 31, 1995 now U.S. Pat. No. 5,791,692.

FIELD OF THE INVENTION

The present invention is directed to a dual sided album leaf and method of making same.

BACKGROUND OF THE INVENTION

Prior art photographic albums typically require the consumer to manually insert conventional prints into a classic sleeve, or use adhesive to bond conventional prints to blank album pages. This is a time consuming, difficult operation that provides less than satisfactory results. Consumers often procrastinate and do not place prints in albums when they receive them from the photofinisher, risking loosing time and event references. A further disadvantage in the prior art photographic albums is that the pages are not uniform in texture, the reflections from the plastic sleeves interfere with viewing, and are prone to tearing. When adhesives are used to maintain the prints in the album, alignment becomes critical. Additionally, many adhesives can damage a print and often fail after time, thus, allowing the prints to fall out of the album. In addition, the multiple layers make for very thick album pages, thus limiting the number of images that can be stored in a given album. Also, in addition to purchasing separate binder album pages, adhesive and other item are sometimes required to be purchased.

It is known in the art to bind prints in a single album, such as a Qualex Galaxy Print Book, but this is limited to one image per single sided page. It is also known in the art that montage prints can be made by digital and conventional optical techniques. However, these montage prints are limited in that they are only available in single-sided form and not specifically designed for use directly into an album.

The present invention solves many of the problems of the prior art that provides a method of making a unitary dual sided album leaf which is relatively easy to produce, relatively thin in construction, and requires no further mounting by the user.

SUMMARY OF THE INVENTION

In one aspect of the present invention, there is provided a method of making a unitary dual sided album leaf having first and second sides. The method includes the steps of:

- providing an image retaining media having an image forming side and a back side;
- printing at least one image on the image forming side of the image retaining media, the image retaining media being composed into first and second image retaining sections;
- folding the image retaining media along a predetermined line, the first and second image retaining sections being positioned such that when the image retaining media is folded, the back side of the first and second image retaining sections will be substantially co-extensive with each other so as to form the first and second sides of the album leaf.

In accordance with another aspect of the present invention, there is provided an unitary dual sided album leaf having first and second sides, the leaf being made of a single sheet of an image bearing media having at least one image formed thereon, the at least one image being grouped into first and second sections, the single sheet being folded and secured together so as to form the album leaf.

In accordance with yet another aspect of the present invention there is provided a method of making an unitary dual sided album leaf having first and second sides, comprising the steps of:

- providing a sheet of image bearing media having an image forming side and a back side;
- providing a digital record having at least one image, composing the at least one image in the digital record into first and second digital sub-records, the first digital sub-record corresponding to a first image retaining section and the second digital sub-record corresponding to a second image retaining section;
- printing the at least one image from said first and second digital sub-records onto the image forming side of the image retaining media; and
- folding of the image retaining media such that the first and second image retaining section are substantially co-extensive with each other.

DETAILED DESCRIPTION OF THE INVENTION

Figure 1:
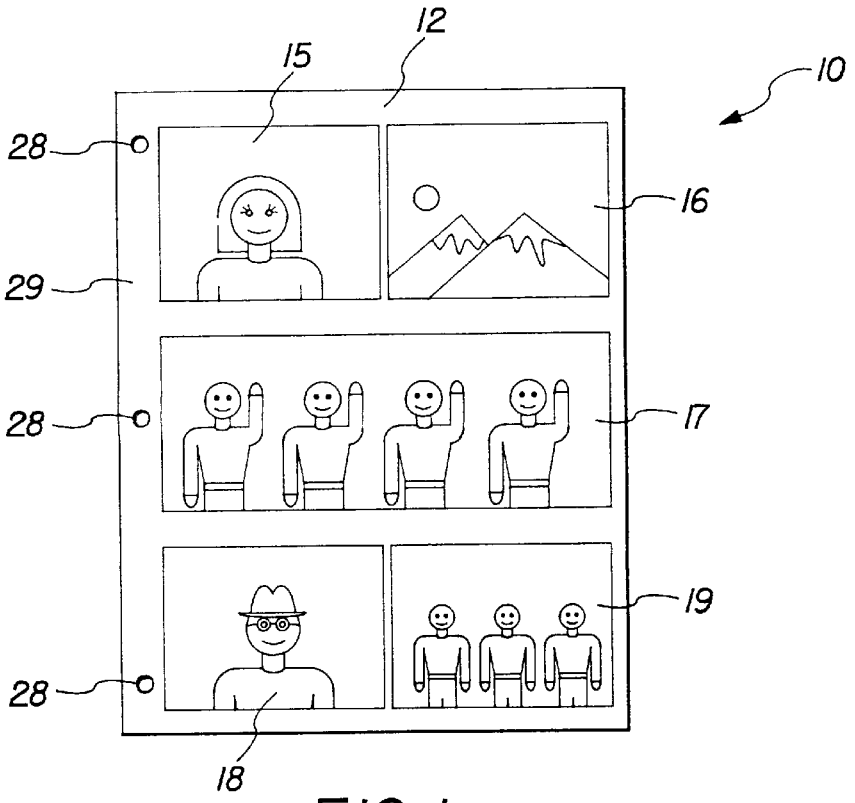
FIG. 1 is a front elevational view of a album leaf made in accordance with the present invention.
Figure 2:
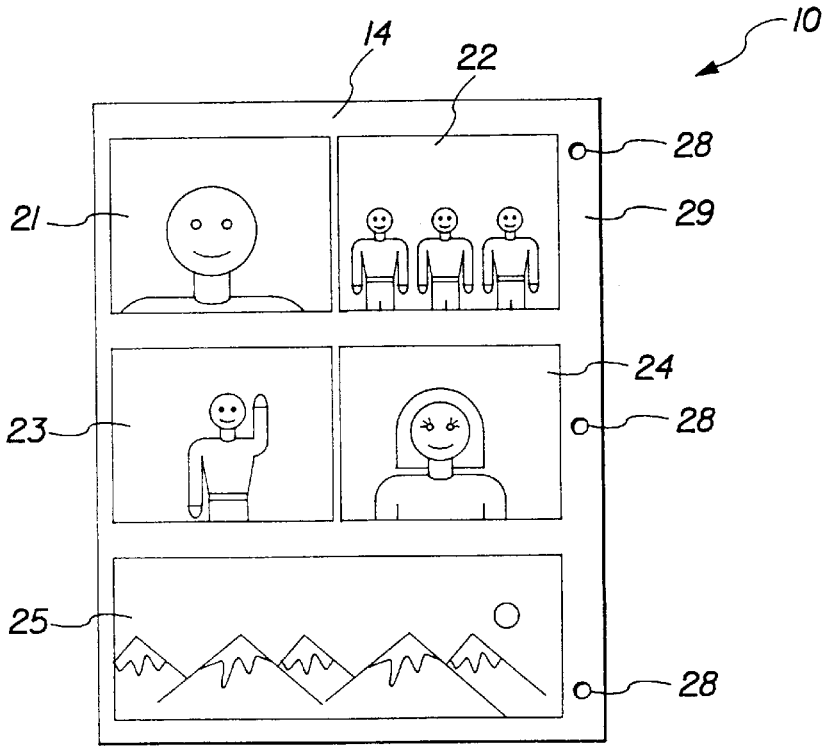
FIG. 2 is a back elevational view of the album leaf of FIG. 1.

Referring the FIGS. 1 and 2, there is illustrated a dual sided album leaf 10 made in accordance with the present invention. In particular, the leaf 10 includes a first side 12 and a second side 14. The first side 12 includes a plurality of images 15,16,17,18,19 and the second side includes a plurality of images 21,22,23,24,25. Also provided in the preferred embodiment is a plurality of holes 28 in a margin area 29, which can be used for mounting of the leaf in an album. The width d of margin area 29 may be of any desired size. In the particular embodiment illustrated, the width d is about one inch (2.54 cm).

As can be seen by FIGS. 1 and 2, the various images are composed so as to substantially fill the space on each side 12,14. Also, as illustrated, various combinations and sizes of prints may be placed together. For example, as illustrated in FIG. 1, the images 15,16,18,19 are substantially identical in size and whereas image 17 is of a different size format. The images have been either automatically composed by the printing device, or printed in accordance with customer instructions. This can be done by optical printers such as the Kodak S-Series Printer, which prints multiple images on a single web of photosensitive paper. Alternatively, digital printers, such as the Kodak PCD 600 CRT Printer and the Kodak HLT-7720 Continuous Tone Digital Printer, can be used which allows for free form formatting of the images. It is, of course, understood that other type printers, such as laser or thermal printers, may be used as desired. In the embodiment illustrated, images 15,16,18,19 each have a size of about 3½ inches×4⅞ inches and image 17 is equivalent to a panoramic-type image, which have a size of approximately 3½ inches×9¾ inches. Likewise, on the second side 14, images 21,22,23,24 are substantially equal size, whereas image 25 is of a substantially greater size.

Figure 3A:
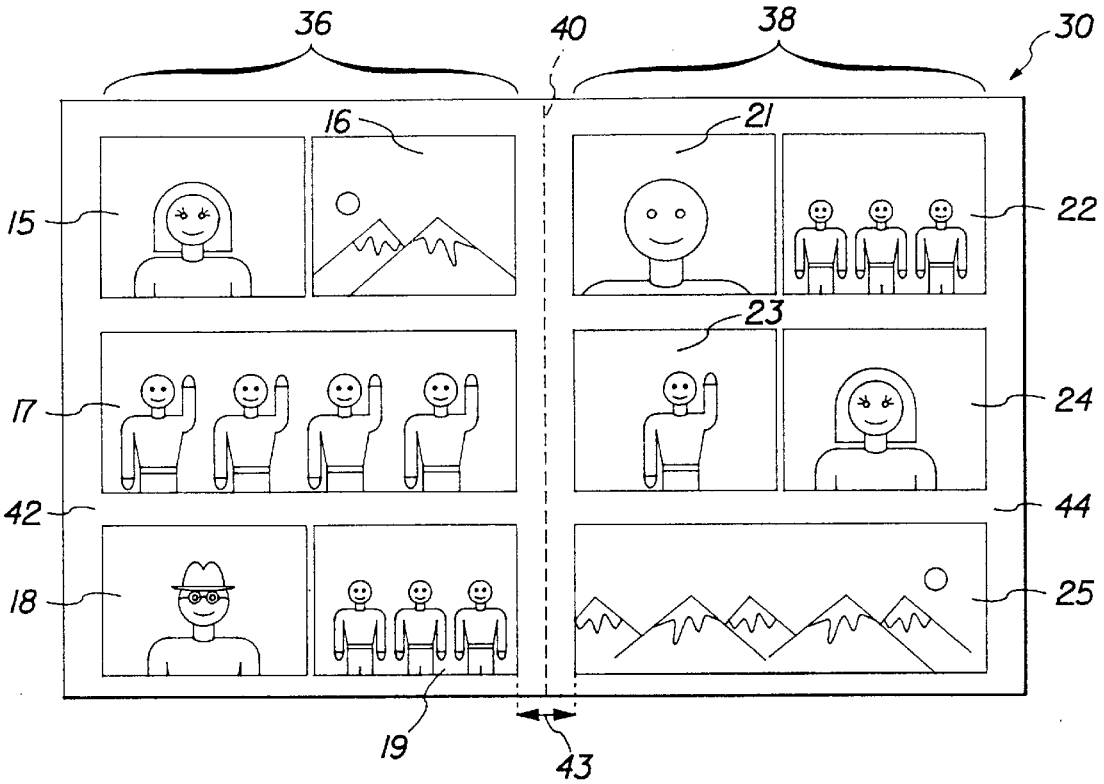
FIG. 3 is a front elevational view of a sheet of photosensitive material from which the album leaf is made.
Figure 3B:
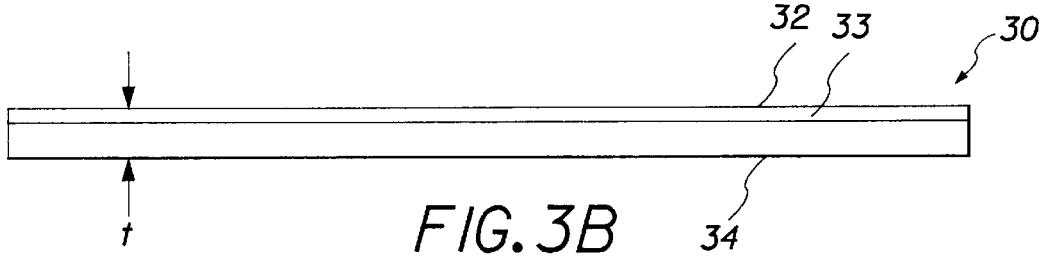

Referring to FIGS. 3*a* and 3*b*, there is illustrated a sheet 30 made of an image bearing media. In the embodiment illustrated, sheet 30 is a photosensitive material. In particular, the photosensitive material is photographic paper which has an image forming side 32 and a back side 34. As is typical with photosensitive material, the image forming side 32 includes an emulsion layer 33 upon which an image can be formed. The back side merely provides the supporting substrata for holding of the emulsion layer. The sheet 30 has a thickness t. The thickness t may be any thickness so desired, preferably the thickness t is minimal so that the album page will not be too thick. Generally the thickness t will be in the range of 0.05 mm to 0.5 mm. In the particular embodiment illustrated, the thickness t is approximately 0.2 mm.

As illustrated in FIG. 3*a*, images 15,16,17,18,19,21,22, 23,24,25 have been formed on the image forming side 32 of sheet 30 by an appropriate printer such as previously described. The images 15,16,17,18,19 have been composed into a first image retaining section 36 whereas images 21,22,23,24,25 have been composed onto a second image retaining section 38. These image retaining sections 36,38 may be sized and configured as desired. Preferably, the image retaining sections 36,38 are designed so as to correspond to the first and second sides 12,14 of leaf 10, respectively. In the preferred embodiment illustrated, a space 43 having a width d1 is provided between first and second image retaining sections 36,38. Also, as preferably illustrated, a fold line 40 (as shown by a dash line) about which the sheet 30 is folded is provided in space 43. The width d1 may be any desired size. In the embodiment illustrated, width d1 is about 1.0 inches (2.54 cm). The fold line 40 is preferably located such that the first image section 36 and second image section 38 are substantially co-extensive with each other. As illustrated, lateral edge portions 42,44 are disposed adjacent first and second image sections 36,38, respectively, and placed adjacent each other so as to form the margin area 29 when sheet 30 is folded.

The images sent to the printer may be obtained by any desired manner. In the preferred embodiment of the present invention, a digital printer, such as the Kodak PCD-600 CRT Printer, is used so that free form formatting can be easily obtained in accordance with instructions provided by the consumer. The digital data information is representative of the images can be obtained by scanning original images, either in the form of prints or negatives as is customarily done in the prior art. However, the digital data information may not be limited to images. The digital data information may also contain other information such as text, or the logos, images, etc. which can be added to the scanned data. Also the digital data may be obtained in any desired manner. For example by computers or other devices which contains digital files. A digital record is formed form the scanned information and any other digital information provided. This digital record is then composed into first and second digital sub-records. The first and second digital sub-records are used to print images in the first and second image retaining sections 36,38, which will correspond to the sides 12,14 of the leaf 10. It is, of course, understood that the images may be composed in any desired manner. Additionally, any text or other information provided may or manipulation of the data may be conducted as desired. For example, but not by way of limitation, text, logos or other images could be added to the scanned images Once the appropriate digital records have been formed, printing by the printer can then be performed whereby the images and other text/images present in the digital records are appropriately printed on the photosensitive material. The developed photosensitive material is then taken from the printer where thereafter it is formed into the leaf 10.

Figure 4:
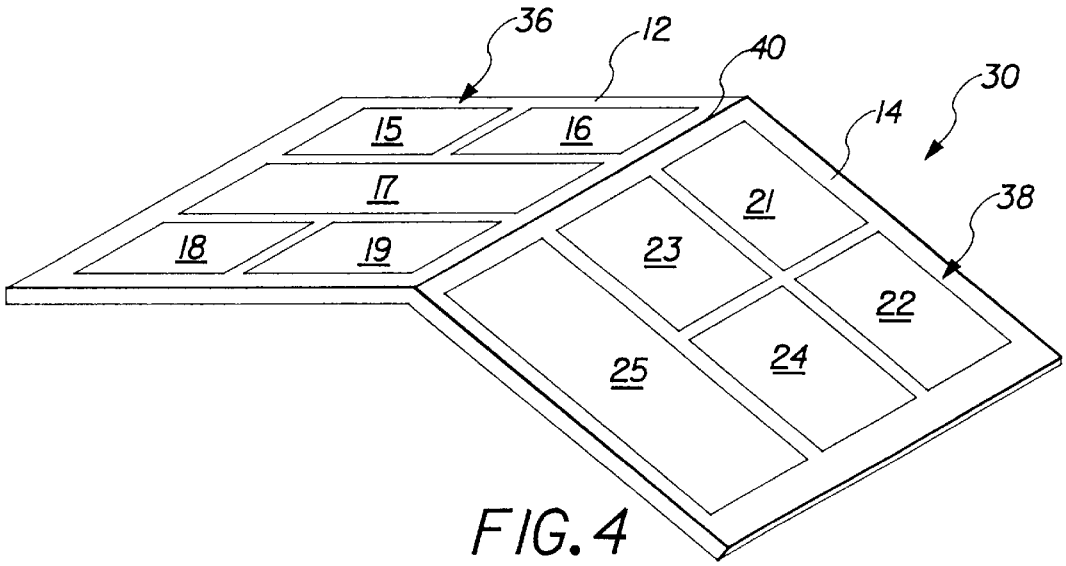
FIG. 4 is a perspective view of the sheet of photosensitive material of FIG. 3 illustrating how it is folded so as to form the photographic album leaf of FIG. 1.
Figure 5:
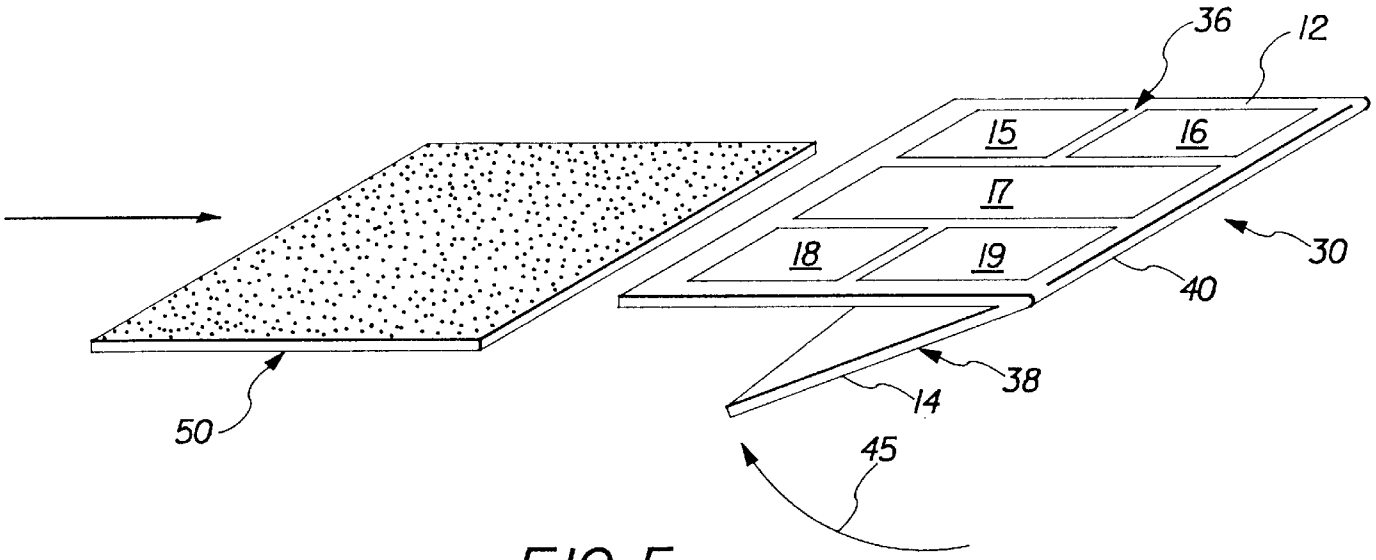
FIG. 5 is a view similar to FIG. 4 illustrating the sheet as it is being folded and a sheet of adhesive material that is placed within the folded sheet of photosensitive material.
Figure 6:
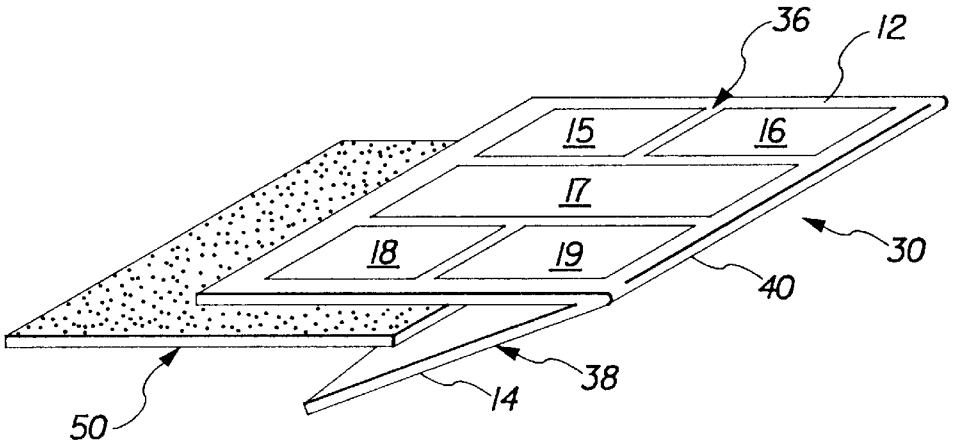
FIG. 6 is a sequential view of the assembly of the dual album leaf of FIG. 5 further illustrating the placement of the adhesive material between the folded sheet.
Figure 7:
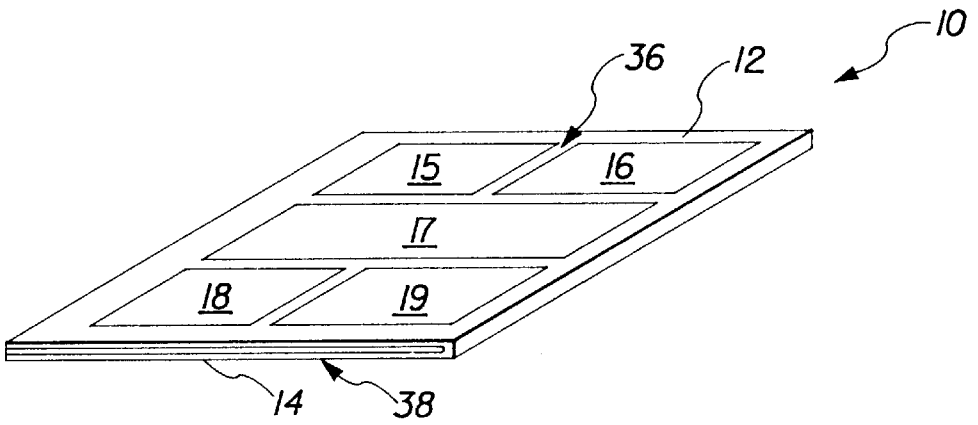
FIG. 7 is a view of the folded photosensitive material of FIGS. 4, 5, and 6.
Figure 8:
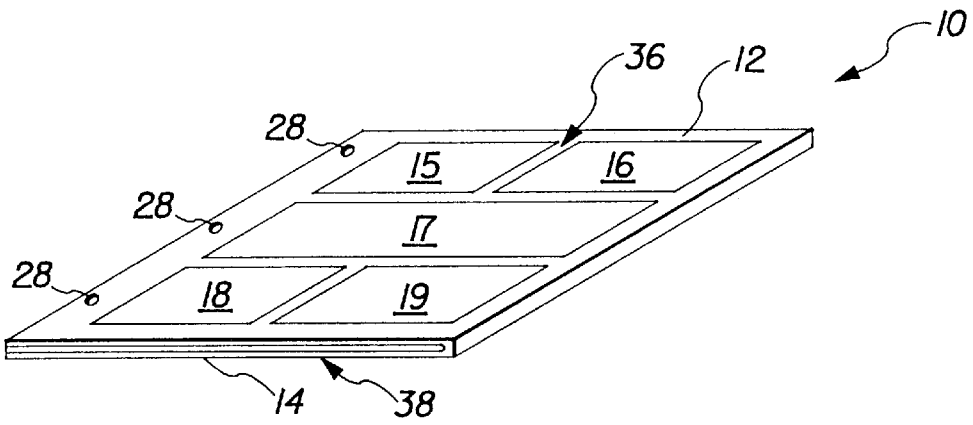
FIG. 8 is a perspective view of the leaf of FIG. 7 illustrating the placement of holes so that the leaf can be placed in the album.

Referring to FIGS. 4, 5, 6, 7, and 8, there is illustrated sequentially the steps that are taken to form the leaf 10 from the sheet 30 illustrated in FIG. 3*a*. Referring to FIG. 4, it can be seen that the sheet 30 has started the folding operation about fold line 40. FIG. 5 illustrates the sheet 30 being further folded in the direction indicated by arrow 45. In the particular embodiment illustrated, a sheet 50 containing an adhesive material on both sides is provided for placement between the folded sections 36,38. As illustrated in FIG. 6, the sheet 50 is placed in between the folded sections 36,38 of sheet 30 and folded together to form leaf 10 as illustrated in FIGS. 5, 7, and 8. FIG. 8 illustrates the addition of the holes 28 which allow for mounting. In the particular embodiment illustrated, the holes 28 are illustrated being substantially round in configuration. However, it is to be understood that the holes may be provided in any desired appropriate configuration.

Figure 9B:
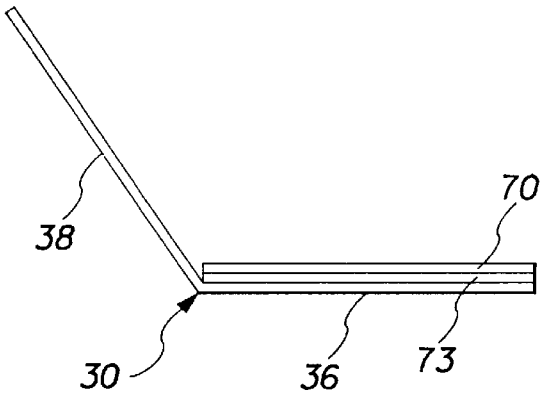
FIGS. 9*a*, 9*b*, and 9*c* illustrate an alternate method for making the leaf of FIGS. 1 and 7.
Figure 9A:
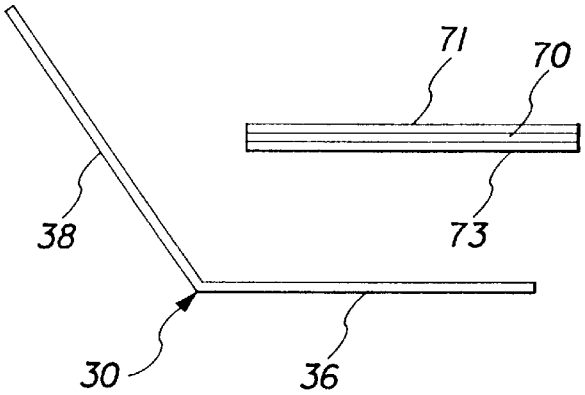
Figure 9E:
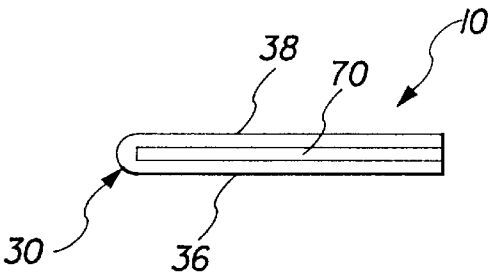
Figure 9D:
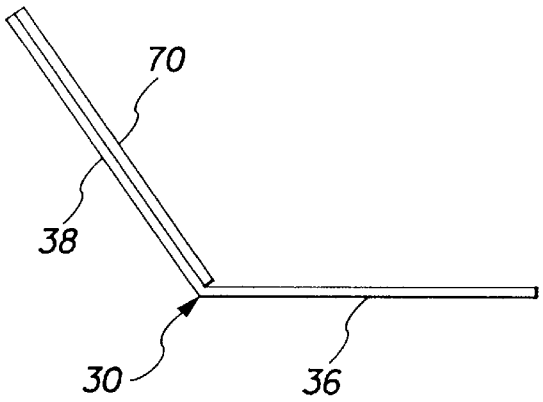
Figure 9C:
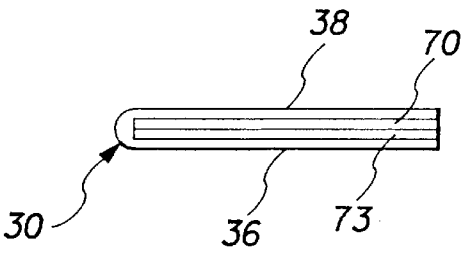

While in the particular embodiment illustrated the adhesive is illustrated as being applied in sheet form, it is to be understood that the sections 36,38 may be adhered together by any appropriate manner so desired. For example, but not by way of limitation, a sheet of heat-activated adhesive material may be provided as illustrated in FIGS. 9*a*, 9*b*, 9*c*, 9*d*, and 9*e*. A sheet 70 having a pair of outer protective layers 71,73 which protect the adhesive layer on the sheet. An example of a suitable heat activated adhesive sheet material is dry mounting tissue sold by the Eastman Kodak Company. The sheet 70 is sized and shaped so as to correspond to one of the image retaining sections 36,38. One of the protective layers is first removed and then affixed to one of the image sections. For example, layer 71 is removed (see FIG. 9*b*.) Section 38 is folded over and secured to sheet 70 (see FIG. 9*c*.) Then, the sheet 30 is opened, protective layer 73 is removed (see FIG. 9*d*), and section 38 is brought into contact with sheet 70 to form leaf 10 as shown in FIG. 9*e*. Thereafter, the other protective layer 73 is removed and the sheet 30 is folded over such that the other image section is adhered to the other adhesive layer on the adhesive sheet. Alternatively, adhesive material can simply be applied by any desired manner to at least a portion of the back side 34 so that when sheet 30 is folded, the sides 32,34 will be permanently bonded together.

As can be seen, the fold on the leaf 10 is provided on the outside edge of the leaf 10. Not only does this provide a smooth finished edge that has a clean crisp appearance, it also provides an edge that is tactile to the touch and is resistant to separation and/or delamination. Additionally folding and securing the photographic sheet 30 as set forth above substantially eliminates any curl that may be present in the photographic paper as the curl on one folded side is offset by the curl other folded side.

The present invention provides a unique dual sided album leaf and method of making the same which is easy and economical to produce and also provides for a custom photographic album leaf and which is relatively economical in cost. Preferably, the folding of sheet 30 is accomplished by the photofinisher, thus eliminating the need for the consumer to do anything further. There are no plastic sleeves or adhesives necessary to mount the prints to an album leaf. In the present invention, the prints are permanently formed as a part of the leaf. Further, since the leaf is a unitary one-piece construction, there is no chance that individual images could be lost due to failure of adhesives or torn sleeves. Additionally, since the album leaf is relatively thin, more album leafs can be provided in the album such that a smaller album can be used to store the same number of images. Also, the present invention has the advantage of allowing the user to add custom editing and additional information on the album leaf. For example, during the composing process, additional data can be placed thereon, allowing the personalization of the photo album.

While the image bearing media is described above as being a photographic media, the present invention is not so limited. For example, but not by way of limitation, images formed by laser printers and digital thermal printers can be used to print the image on the image bearing media. The Kodak XL7720 Digital Color Thermal Printer can be used to make the sheet 30 from which the leaf is formed.

It is to be understood that various other changes and modifications may be made without departing from the scope of the present invention. The present invention being defined by the following claims.

PARTS LIST

10 . . . album leaf
12 . . . first side
14 . . . second side
15,16,17,18,19,21,22,23,24,25 . . . images
28 . . . holes
29 . . . margin area
30 . . . sheet
32 . . . image forming side
33 . . . emulsion layer
34 . . . back side
36,38 . . . retaining sections
40 . . . fold line
43 . . . space
42,44 . . . lateral edge portions
45 . . . arrow
50 . . . sheet
70 . . . sheet
71,73 . . . outer protective layers

We claim:

1. A method of making a unitary dual sided album leaf having first and second sides, comprising the steps of:

providing an image bearing media having an image forming side and a back side;

printing at least one image on the image forming side of said image bearing media, said image bearing media comprising a first image retaining section and a second image retaining section separated from said first image retaining section by a fold line; and folding said image bearing media along said fold line so that said first and second image retaining sections are substantially co-extensive and said at least one image on said image bearing media face outward.

2. A method according to claim 1 further comprising the step of providing an adhesive on the back side of said image bearing media.

3. A method according to claim 1 wherein the image bearing media further comprises a margin area, said margin area having holes for holding of said leaf in an album.

4. A method according to claim 1 wherein the image bearing media is a sheet of photosensitive material.

5. A method according to claim 1 wherein said printing of said at least one image comprises the step of using a CRT printer.

6. A method according to claim 1 further comprising the step of providing additional textual or image digital information to said at least one image.

7. A method according to claim 1 wherein said printing of said at least one image comprises the step of using a laser printer.

8. A method according to claim 1 wherein said printing of said at least one image comprises the step of using a thermal printer.

9. A method according to claim 1 wherein said printing of said at least one image comprises the step of using an optical printer.

10. A method of making a unitary dual sided album leaf having first and second sides, comprising the steps of:

providing an image bearing media having an image forming side and a back side;

providing a digital record having at least one image and composing said at least one image in said digital record into first and second digital sub-records, said first digital sub-record corresponding to a first image retaining section on said image bearing media, and said second digital sub-record corresponding to a second image retaining section on said image bearing media, said first image retaining section being separated from said second image retaining section by a fold line;

printing said images of said first and second digital sub-records onto said image forming side of said image retaining media; and folding said image bearing media at said fold line so that said first and second image retaining sections are substantially co-extensive with each other.

11. A method according to claim 10 further comprising the step of providing an adhesive on the back side of said image bearing media.

12. A method according to claim 10 further comprising providing a margin area on said leaf, said margin area having holes for holding of said leaf in an album.

13. A method according to claim 10 wherein said image bearing media is a sheet of image bearing media.

14. A method according to claim 10 wherein said printing of said at least one image comprises the steps of using a CRT printer.

15. A method according to claim 14 wherein text information is provided in said first and/or second image retaining sections.

16. A method according to claim 10 wherein said printing of said at least one image comprises the step of using a laser printer.

17. A method according to claim 10 wherein said printing of said at least one image comprises the step of using a thermal printer.

18. A method according to claim 10 further comprising the step of providing textual or digital image information to said digital record.

19. A method of making a unitary dual sided album leaf having first and second sides, comprising the steps of:

providing an image bearing media having an image forming side and a back side;

providing a digital record having a plurality of images, said plurality of images being printed into first and second image retaining sections said first image retaining section being separated from said second image retaining section by a fold line; and folding said image bearing media along a fold line so that said first and second image retaining sections are substantially co-extensive with the images on said image bearing media facing outward.

20. A method according to claim 19 further comprising the step of providing an adhesive on the back side of said image bearing media.

21. A method according to claim 19 further comprising the step of providing holes in a margin area for holding of said leaf in an album.

22. A method according to claim 19 wherein said image bearing media is a sheet of photosensitive material.

23. A method according to claim 19 wherein said printing of said at least one image comprises the steps of using a CRT printer.

24. A method according to claim 19 wherein text information is provided in said first and/or second image retaining sections.

25. A method according to claim 10 wherein said printing of said at least one image comprises the step of using a laser printer.

26. A method according to claim 10 wherein said printing of said at least one image comprises the step of using a thermal printer.

27. A method according to claim 10 wherein said plurality of images are obtained by scanning an image so as to obtain said digital record.

28. A method according to claim 10 further comprising the step of providing textual or digital image information to said digital record.

29. A method according to claim 19 wherein said printing of said at least one image comprises the step of using an optical printer.

30. A method of making a unitary dual sided album leaf having first and second sides, comprising the steps of:

providing a sheet of image bearing media having an image forming side and a back side;

providing a digital record having a plurality of images and composing said plurality of images in said digital record into first and second sub-records, said first sub-record corresponding to a first image retaining section on said image bearing media, and said second digital sub-record corresponding to a second image retaining section on said image bearing media, said first image retaining section being separated from said second image retaining section by a fold line;

printing said image in the first and second sub-records onto said image forming side of said image bearing media; and folding said image bearing media along said fold line so that said first and second image retaining sections are substantially co-extensive with each other.

* * * * *